US006623100B1

(12) United States Patent
Baitz et al.

(10) Patent No.: US 6,623,100 B1
(45) Date of Patent: Sep. 23, 2003

(54) PRINTER WITH TWO PRINTING STATIONS

(75) Inventors: Guenter Baitz, Berlin (DE); Wolfgang Malke, Berlin (DE)

(73) Assignee: Wincor Nixdorf GmbH & Co. KG, Paderborn (DE)

( * ) Notice: Subject to any disclaimer, the term of this patent is extended or adjusted under 35 U.S.C. 154(b) by 0 days.

(21) Appl. No.: 10/049,781

(22) PCT Filed: Jul. 28, 2000

(86) PCT No.: PCT/DE00/02484

§ 371 (c)(1),
(2), (4) Date: Feb. 15, 2002

(87) PCT Pub. No.: WO01/15906

PCT Pub. Date: Mar. 8, 2001

(30) Foreign Application Priority Data

Aug. 26, 1999 (DE) ..... 199 40 586

(51) Int. Cl.[7] ..... B41J 23/00; B41J 2/14
(52) U.S. Cl. ..... 347/37; 347/49
(58) Field of Search ..... 347/50, 37, 49; 400/82, 149, 692

(56) References Cited

U.S. PATENT DOCUMENTS 4,668,961 A 5/1987 Hiramatsu
5,160,942 A 11/1992 Omata et al.

FOREIGN PATENT DOCUMENTS

| | | | |
|---|---|---|---|
| DE | 2 232 590 | 1/1974 | |
| DE | 25 06 632 | 8/1976 | ..... B41J/3/62 |
| DE | 196 42 565 A1 | 10/1997 | ..... B41J/2/01 |
| EP | 0 127 145 A1 | 12/1984 | ..... B41J/3/54 |
| EP | 0 195 949 B1 | 10/1986 | ..... B41J/25/24 |
| EP | 0 359 580 A1 | 3/1990 | ..... B41J/3/54 |
| EP | 0 492 955 A2 | 7/1992 | ..... B41J/25/34 |
| EP | 0 623 471 A2 | 1/1994 | ..... B41J/2/175 |
| WO | WO 90/10917 | 9/1990 | ..... B41J/3/62 |
| WO | WO 95/29064 | 11/1995 | ..... B41J/25/34 |

*Primary Examiner*—Judy Nguyen
(74) *Attorney, Agent, or Firm*—McCormick, Paulding & Huber LLP

(57) ABSTRACT

In a printer with two printing stations, two printin-head holders (22) with holding means (26, 30) for the detachable holding of one print head (24, 48) each are arranged on a carriage (16) guided displaceably parallel to a print backing means (36). The respective printing-head holder (22) is designed for a first type of printing head (24) and can be connected to a printing-head adapter which, in turn, is designed to hold a printing head (48) of a different type.

10 Claims, 3 Drawing Sheets

PRINTER WITH TWO PRINTING STATIONS

TECHNICAL FIELD

The invention relates to a printer comprising two printing stations, each having a printing head which can be mounted on a carriage guided displaceably parallel to a print backing means.

PRIOR ART

A printer of the type mentioned above is disclosed, for example, by EP B 0 195 949. It is used, for example, as a cash-register printer having a printing station each for voucher/journal and receipt. In the case of the known printer, in each case the entire printing system can be constructed as an interchangeable subassembly on a printing station which, in addition to the printing head, also comprises the print backing means, the transport and guiding means for the line feed and, if appropriate, also the ink carrier device. This provides the option of producing the printer in its basic form in very large numbers, it being possible for the equipment of the various printing stations to be defined individually in accordance with the wish of the customer at any time until immediately before delivery. Furthermore, the customer also has the option of himself changing individual printing stations from one printing process to another, without having to buy a completely new printer. However, changing from one printing process to another requires the replacement of the entire subassembly, as already mentioned above.

DE OS 2 232 590 further discloses a printer having a carriage which can be moved parallel to a print backing means and on which different printing heads can optionally be plugged.

EP A 0 623 471 describes an inkjet printer having a printing station in which in each case printing heads containing different printing colors are arranged on a carriage. The printing heads are used to print on one and the same recording medium.

EP A 0 359 580 discloses a printer having two printing stations, each of which has a carriage guided displaceably parallel to a print backing means. Provided on each carriage is a printing head holder which is fixed to the carriage and which, in turn, in each case contains six holders for six individual wire printing heads. The printing directions of the printing stations are oriented at right angles to one another.

SUMMARY OF THE INVENTION

The invention is based on the object of specifying a printer of the type mentioned at the beginning in which the two printing stations take up little space and can be changed over in a very simple way from one printing process to another.

For a printer which has a carriage with two printing-head holders fixed to the carriage and having holding means for the detachable holding of a printing head each, this object is achieved by the characterizing features of claim 1.

Arranging both printing-head holders on one and the same carriage permits a space-saving arrangement of the two printing stations in the printer. For the transition from one printing process to another within a printing station, it is merely necessary for the printing head itself to be replaced.

The respective printing-head holder is designed for a first type of printing head and can be connected to a printing-head adapter which, in turn, is designed to hold a printing head of a different type. In order to interchange the printing head, one therefore needs merely to replace the printing head of the first type by the adapter connected to the printing head of a different printing technology. In this case, the configuration of the printing-head holder and the replacement operation are particularly simple if the printing-head adapter can be connected to the printing-head holder by the holding means on the latter, that is to say if the adapter, at its end facing the printing-head holder, is configured in the same way as the printing head of the type intended for direct insertion into the printing-head holder.

Replacing the printing head is particularly simple if the holding means are designed as latching means, so that the replacement of the printing heads can be carried out without the aid of tools.

In a preferred embodiment of the printer according to the invention, the printing-head holder is in each case designed to hold an inkjet printing head, while the printing-head adapter is designed to hold a dot-matrix printing head. Depending on whether it is wished to print single sheets or, for example, carbonless sets for receipts, it is possible either for inkjet printing heads to be used on both printing stations or for an inkjet printing head to be used on one printing station and a dot-matrix printing head to be used on the other printing station.

For the simultaneous printing of vouchers and receipts, it is particularly advantageous if the printing-head holders are arranged on the carriage in such a way that the printing direction of the printing heads held in them are at right angles to each other.

Both printing stations are preferably activated by the same control device, it then being expedient for a distributor circuit to be arranged on the carriage, being connected to the control device and having a connection for each printing head. When the printing heads are replaced, it is therefore merely necessary for the respective printing head to be connected to the correct connection of the distributor circuit.

The connection between the control device and the distributor circuit is preferably a flat ribbon connector, in particular a flexible ribbon.

BRIEF DESCRIPTION OF THE DRAWINGS

The following description explains the invention in conjunction with the appended drawings, using an exemplary embodiment. In the drawings.

DESCRIPTION OF AN EMBODIMENT OF THE INVENTION

Figure 1:
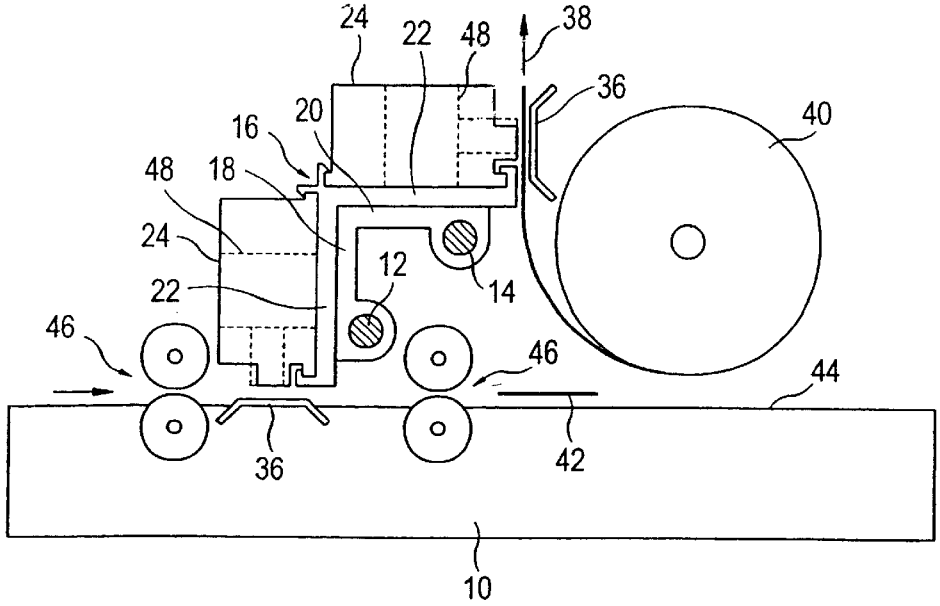
FIG. 1 shows a schematic, partly sectioned side view of a printer according to the invention.

In FIG. 1, 10 designates the base of a printer frame, above which two guide rods 12, 14 extending at right angles to the plane of the figure are arranged, on which a carriage 16 is guided displaceably. The carriage 16 comprises two legs 18 and 20 oriented at right angles to each other and, by means of a motor (not illustrated), is moved on the guide rods 12 and 14 in the longitudinal direction of the same.

Figure 2:
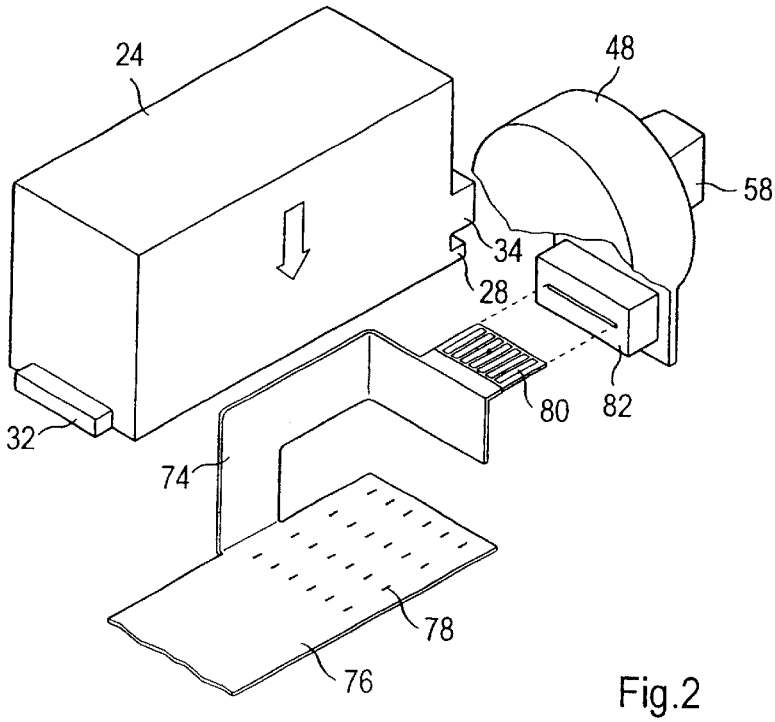
FIG. 2 shows a schematic perspective illustration of the connection between an inkjet printing head and a dot-matrix printing head, with the respective electric connections.
Figure 3:
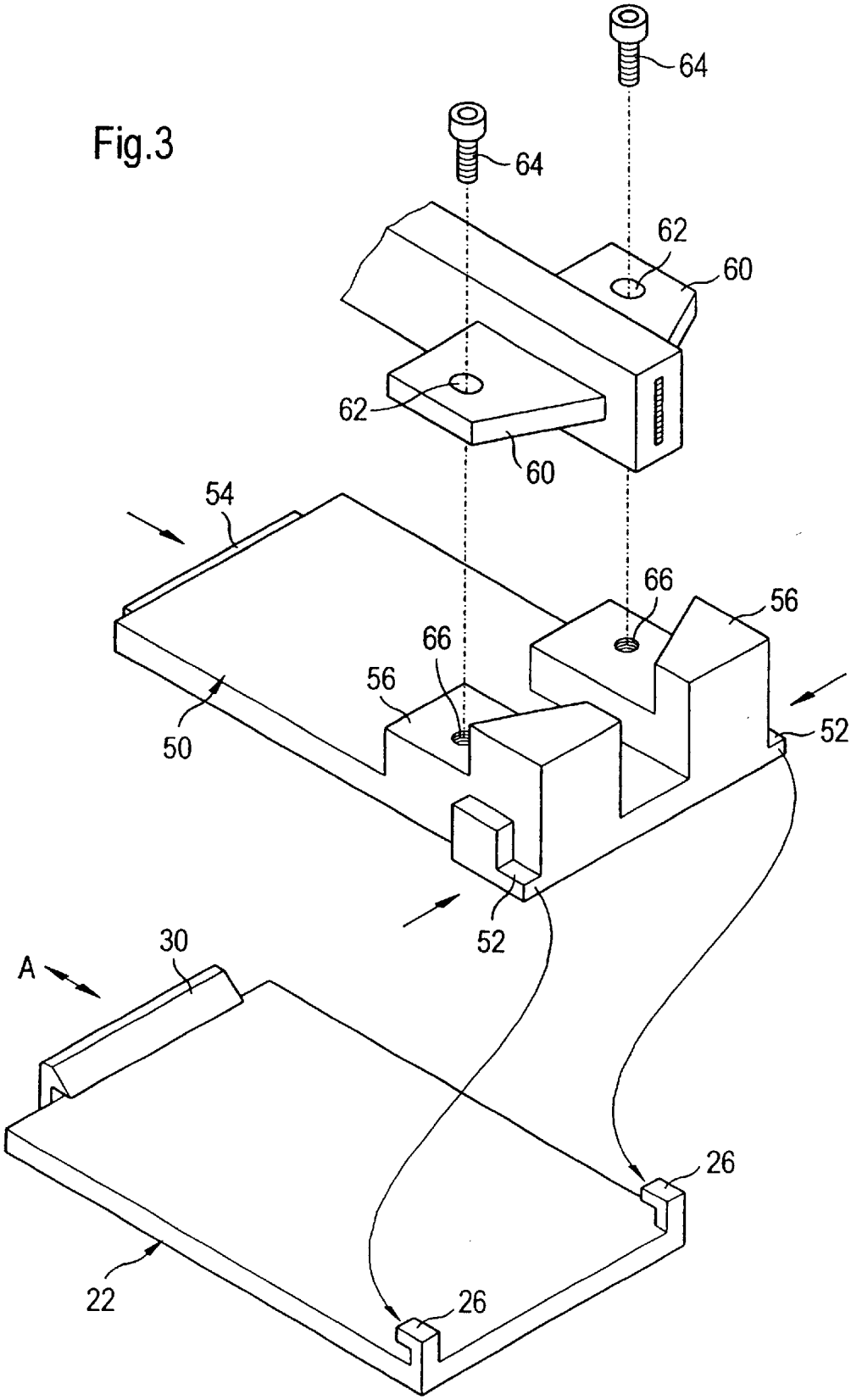
FIG. 3 shows a schematic perspective illustration of a printing-head holder and an adapter for holding a dot-matrix printing head.

The legs 18 and 20 in each case carry a plate-like printing-head holder 20, which is intended to hold an inkjet printing head 24 and is illustrated in more detail in FIG. 3. On one narrow side of the rectangular plate-like printing-head holder 22 there are two claws 26, which are intended to engage over a strip or two attachments 28 on the box-like housing of the inkjet printing head 24. Formed on the opposite narrow side is a hook 30, which can be deflected resiliently in the direction of the double arrow A in FIG. 3 and, preferably like the claws 26 is formed in one piece with the printing-head holder 22. It is used for the purpose of engaging over a strip 32 (FIG. 2) provided on the housing of the inkjet printing head 24 when the inkjet printing head 24 is inserted into the printing-head holder 22. The insertion of the inkjet printing head 24 into the printing-head holder 22 is carried out by the attachments 28 of the inkjet printing head 24 initially being pushed under the claws 26 and then being pressed onto the plate-like printing-head holder 22, the hook 30 initially being deflected out by the strip 32 on the inkjet printing head 24 and then snapping over the strip 32. In order to detach the inkjet printing head 24 from the printing-head holder 22, the hook 30 must first be deflected out again in the opening direction, and then the inkjet printing head 24 can be lifted off the printing-head holder 22.

In FIG. 1, two inkjet printing heads 24 have been mounted on the two printing-head holders 22 and each point with a mouthpiece 34 towards a print backing means 36. Printing head 24 and print backing means 36 in each case form a printing station. The upper printing station illustrated in FIG. 1, in which the inkjet printing head 24 is arranged with horizontal printing direction, is used to print out, for example, a voucher and/or journal on a strip-like recording medium 38, which is drawn off a supply roll 40, which is mounted in the printer frame in a manner not illustrated. The other printing station, in which the inkjet printing head 24 is arranged with vertical printing direction, is used for printing receipts 42 which, on the horizontal printing medium support surface 44 of the base 10, can be drawn in, ejected and transported during the printing operation with the aid of pairs of transport rollers 46.

If, for example, receipts with a carbon copy are to be printed, then this is not possible with an inkjet printing head 34. However, a dot-matrix printing head is suitable for this purpose, is indicated dashed in the printing stations in FIG. 1 and is designated by 48. In order to fix the dot-matrix printing head 48 to the carriage 16, use is made of an adapter 50 illustrated in FIG. 3. The adapter has the form of a rectangular plate which, just like the housing of the inkjet printing head 24 has attachments 52 corresponding to the attachments or the strip 28 on one narrow side, and a strip 54 on the opposite narrow side. Using the attachments 52, the adapter 50 is pushed under the claws 26 belonging to the printing-head holder 22. The adapter 50 is then pressed against the printing-head holder 22, until the hook 30 snaps in over the strip 54. Detaching the adapter 50 from the printing-head holder 22 is carried out in the same way as described for the inkjet printing head 24.

On its upper side, the adapter 50 has two bearing blocks 56, between which a dot-matrix printing head 48 illustrated in FIG. 3 only by its mouthpiece 58, can be mounted. To this end, wing-like flanges 60 are formed on the mouthpiece 58, each having a bore 62 through which a screw 64 engages into a threaded hole 66, formed in the respective bearing block 56.

Figure 4:
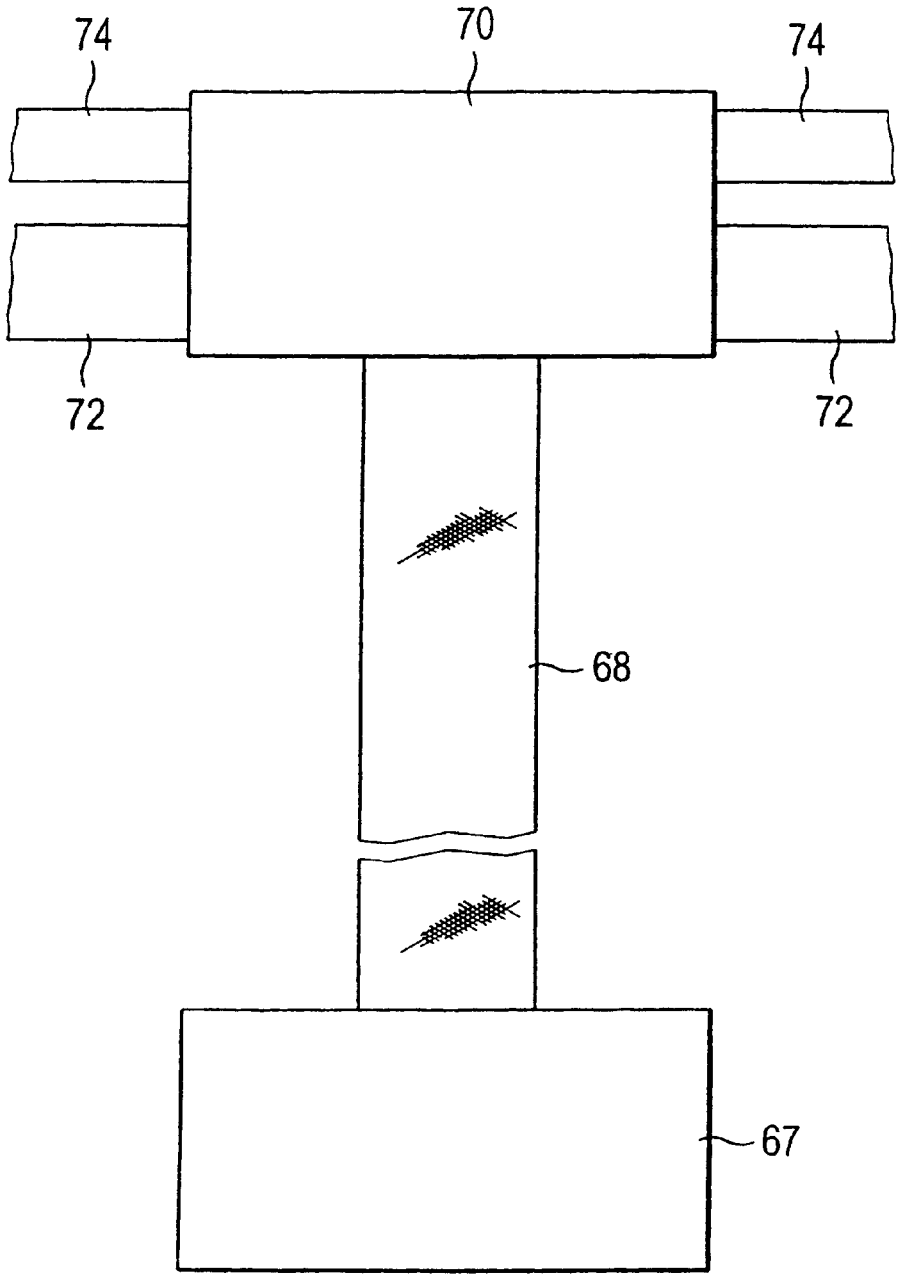
FIG. 4 shows a schematic plan view of a distributor circuit provided on the printing-head holder.

The printer contains a control device 67 which is illustrated schematically in FIG. 4 and is connected via a flexible ribbon, that is to say a flat ribbon cable or a flexible printed circuit board 68, to a distributor circuit or board 70, which is fixed to the carriage 16 in a manner not illustrated. The flexible ribbon 68 comprises power supply lines and control lines. From the distributor circuit 70, in each case connections 72 for the inkjet heads 24 and connections 74 for the dot-matrix printing heads 48 originate. A connection 72 for an inkjet printing head 24 comprises a contact section 76 arranged on the printing-head holder 22 and having individual contacts 78, which can come into contact with corresponding mating contacts (not illustrated) on the underside of the inkjet printing head 24 illustrated in FIG. 2 when the inkjet printing head 24 is inserted into the printing-head holder 22.

The connection 74 for the respective dot-matrix printing head ends in a multipole connector 80 which can be plugged into a corresponding mating connector 82 on the dot-matrix printing head.

The conductor tracks for power supply are intended for all the heads. The control lines are associated with the connections of the respective heads. In order that the number of lines in the flexible ribbon 68 does not become too great, switches can be provided on the distribution board which, during the mounting of two identical heads, ensure that only the respectively selected head is activated. It is then only possible to print either on voucher/journal or receipt. In the other case, when a inkjet head and a dot-matrix head are operated, it would be possible on the other hand to operate in parallel on both the printing stations.

As the above description shows, the printing heads can be replaced in a very simple way, it being possible for each possible combination of two different printing heads to be provided in the two printer stations.

What is claimed is:

1. A printer comprising two printing stations, each having a printing head which can be mounted on a carriage guided displaceably parallel to a print backing means, the carriage having two printing-head holders fixed to the carriage and having holding means for the detachable holding of one printing head in each station, characterized in that each printing-head holder is designed for a first type of printing head and can be connected to a printing-head adapter which, in turn, is designed to hold a printing head of a different type.

2. The printer as claimed in claim 1, characterized in that the printing-head adapter can be connected to each printing-head holder by the holding means provided on each printing-head holder.

3. The printer as claimed in claim 1, characterized in that the holding means are designed as latching means.

4. The printer as claimed in claim 1, characterized in that the printing-head holder is in each station designed to hold an inkjet printing head.

5. The printer as claimed in claim 1, characterized in that the printing-head adapter is designed to hold a dot-matrix printing head.

6. The printer as claimed in claim 1, characterized in that the printing-head holders are arranged in such a way that the printing directions of the printing heads held in them are at right angles to each other.

7. The printer as claimed in claim 1, further comprising a control device common to the two printing stations.

8. The printer as claimed in claim 7, characterized in that a distributor circuit connected to the control device is arranged on the carriage and has a connection for each printing head.

9. The printer as claimed in claim 8, characterized in that the connection for an inkjet printing head comprises a contact section arranged on the corresponding printing head holder and having individual contacts, which are intended to make contact with corresponding mating contacts on the inkjet printing head, and in that the connection for the printing head of the different type branches off the connection at the end of the printing head holder bearing the contact section.

10. The printer as claimed in claim 8, characterized in that the connection between the control device and the distributor device is a flat ribbon connector.

* * * * *